United States Patent [19]

Clifford et al.

[11] Patent Number: 4,468,656

[45] Date of Patent: Aug. 28, 1984

[54] EMERGENCY SIGNALLING UNIT AND ALARM SYSTEM FOR RESCUING ENDANGERED WORKERS

[76] Inventors: Thomas J. Clifford, 6 Massachusetts Ave., Massapequa, N.Y. 11758; Bernard L. Jansen, 529 Asharoken Ave., Northport, N.Y. 11768

[21] Appl. No.: 276,724

[22] Filed: Jun. 24, 1981

[51] Int. Cl.[3] ..... G08B 1/08

[52] U.S. Cl. ..... 340/539; 340/294; 340/321; 340/573; 455/100

[58] Field of Search ..... 340/539, 573, 525, 586, 340/686, 689, 291, 293, 299, 307, 321, 326, 292, 294; 179/5 R, 5 P; 455/91, 95, 94, 100, 104, 28

[56] References Cited

U.S. PATENT DOCUMENTS

| | | | |
|---|---|---|---|
| 3,323,117 | 5/1967 | Mason | 340/321 |
| 3,603,952 | 9/1971 | Smith | 340/539 |
| 4,021,807 | 5/1977 | Culpepper et al. | 340/539 |
| 4,121,160 | 10/1978 | Cataldo | 340/539 |
| 4,218,763 | 8/1980 | Kelley et al. | 340/539 |

FOREIGN PATENT DOCUMENTS

| | | | |
|---|---|---|---|
| 7705352 | 11/1978 | Netherlands | 340/573 |

OTHER PUBLICATIONS

Ellis Cobem, "Honorary Companion of the Institute of Electronics", Jun. 1979, pp. 1, 2, 1–4.

"The Time has Come", Robert W. Grant, Fire Command, Oct. 1979, p. 17.

*Primary Examiner*—Donnie L. Crosland

*Attorney, Agent, or Firm*—Pollock, Vande Sande & Priddy

[57] ABSTRACT

An emergency signalling unit which is designed to be carried on the person of a fireman or other worker to alert control personnel should the worker become endangered, and an alarm system which incorporates a plurality of such signalling units, each one worn by a different fireman, for providing an alarm at a central station and an indication of which fireman is in trouble, as well as a means of locating him. The emergency signalling unit includes a radio transmitter, a high intensity strobe lamp, and an audio frequency generator. The alarm system includes a plurality of the above-mentioned radio transmitters, each transmitting on a different carrier frequency, and a receiver at a central control station exterior to the burning building, which is equipped to identify the respective carrier signals and to provide a visual indication of which fireman is in trouble as well as an audible signal to alert control personnel to the existence of an alarm condition.

9 Claims, 11 Drawing Figures

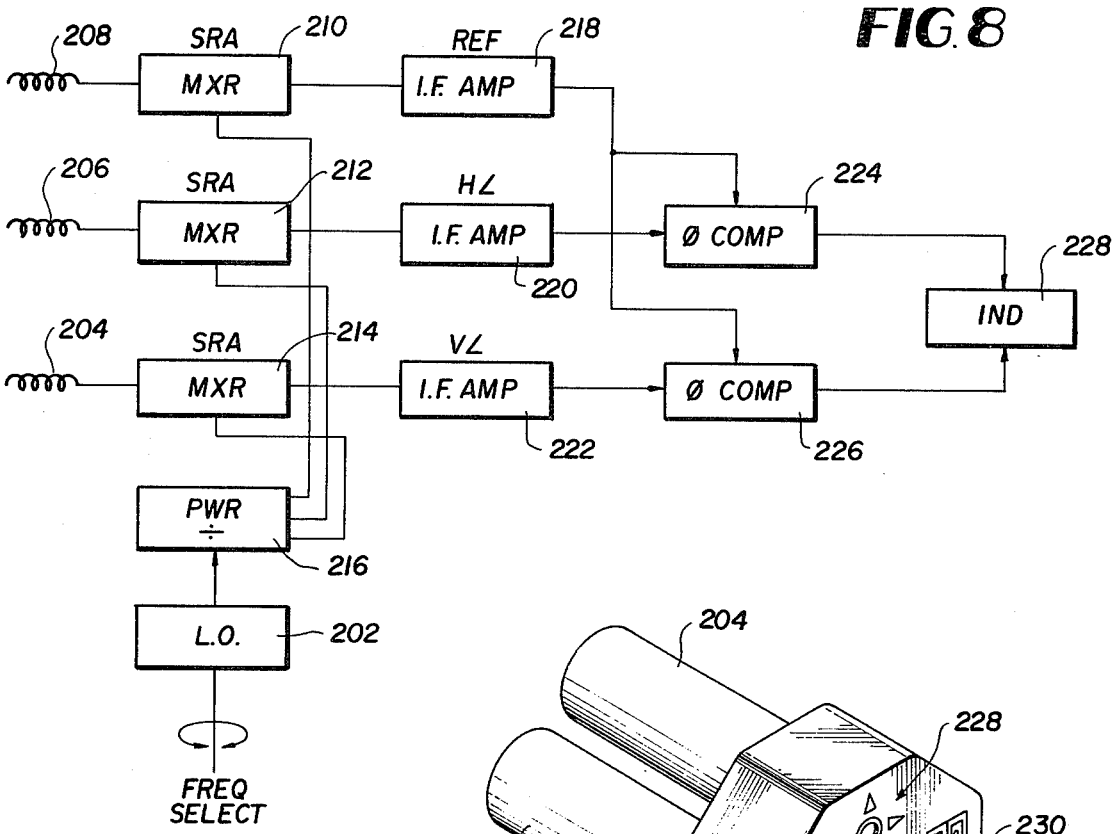
FIG. 8
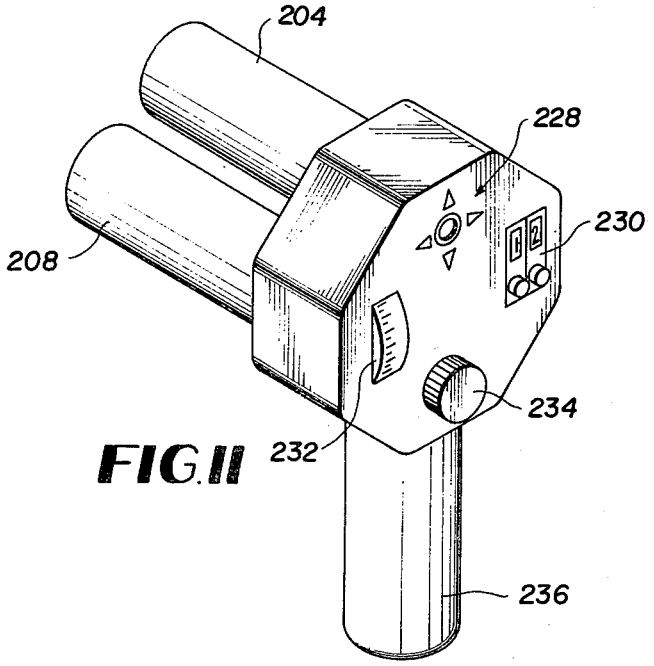
FIG. 11
FIG. 9
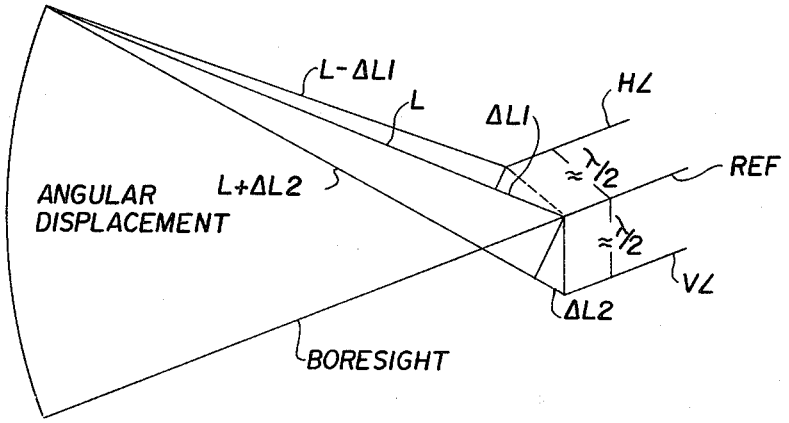

EMERGENCY SIGNALLING UNIT AND ALARM SYSTEM FOR RESCUING ENDANGERED WORKERS

The present invention is directed to an emergency signalling unit which is designed to be carried on the person of a fireman or other emergency worker to alert control personnel should the worker become endangered, and is also directed to an alarm system which incorporates a plurality of such signalling units, each worn by a different fireman, for providing an alarm at a central station and an indication of which fireman is in trouble, as well as a means of locating him.

On an almost weekly basis, the news carries reports of firemen who have been killed in burning buildings because they were unable to alert colleagues on the outside of their plight. Thus, fireman working in such buildings often become disoriented or lost because of smoke inhalation or darkness, or become immobolized because of injury, and are unable to communicate their situation to others who might have been able to save them if they had been alerted. Also, while firemen on the outside of a burning building may sometimes be aware that co-workers are missing inside of the building, they may not know where in the building to look and a general search may not only be time consuming, but also prohibitively dangerous. Further, knowledge about missing persons and rescue procedures may be even more difficult in a volunteer fire department where procedures may not be as well-rehearsed, and different combinations of personnel may be working from one fire to the next.

While devices have been proposed in the prior art to aid in the location of endangered firemen, in general they have not provided satisfactory results. For example, U.S. Pat. No. 3,201,771 to Proulx and U.S. Pat. No. 3,142,883 to Bosley et al disclose arrangements in which flashing lights and an audible alarm are mounted on a fireman's helmet. While such devices may be of some use in helping firemen who are nearby enough to see or hear the alarms rescue endangered co-workers, if nobody is near enough, if the potential rescuers vision is blocked, or if the environment is noisy, such devices may be of little or no use. Certainly, they do not reliably alert rescue personnel of the endangered fireman and his whereabouts, which is considered to be necessary by the present inventors.

It is therefore an object of the present invention to provide an apparatus for reliably alerting rescue personnel of fireman or other workers who are endangered.

It is a further object of the present invention to provide a system for effectively locating the endangered firemen, once the outside world has been alerted to their difficulty.

In accordance with the invention, an emergency signalling unit, designed to be worn on the person of the fireman or worker is provided. The unit includes a radio transmitter means for generating a radio signal, a high intensity lamp means for providing a visual emergency signal, an audio frequency generator means for providing an audible signal, and a self-contained rechargeable or replaceable power supply. The signalling means are activated either by a manual switch which is turned on by the fireman when he needs help or by a variety of automatic switch means which are responsive to lift endangering conditions, such as the fireman's physical condition, the level of the self-contained air supply which he carries, or the ambient atmosphere.

In accordance with a further aspect of the invention, a complete alerting and locating alarm system is provided in which a plurality of signalling units as described above, and for emitting a modulated carrier alarm signal are included, each such unit being worn by a different fireman. Each radio transmitter is designed to transmit on a different carrier frequency, and a receiver at a central control station exterior to the burning building is equipped to test that a useable r.f. path exists, to identify the respective carrier signals, and to provide a visual indication of which fireman is in trouble as well as an audible signal to alert control personnel to the existence of an alarm situation. In one embodiment of the invention, a relay is provided in the building for amplifying and re-transmitting signals which have become attenuated by the structural elements of the building, and in this case the relay may be arranged to convert the different carrier signals to a common carrier frequency having different respective modulation signals impressed thereon, for re-transmission.

After the control personnel identify the particular fireman who needs help at the central control panel, his location is determined with the aid of a portable hand-held or gear-mounted radio direction finder. When the rescuer is close enough to the endangered fireman, he will also be aided by either or both of the visual or audible alarm means which form part of the emergency signalling unit. Also, fellow fireman working in the building may be able to locate the person in trouble with the aid of the visual and audible signalling means alone.

Thus, in accordance with the invention, providing all three, i.e. radio, light and sound signalling modes, provides the rescuer with the greatest opportunity and the best possible chance of locating an endangered fireman. It is well-know that the scene of a fire is often a chaotic one and that many times the person in trouble is under debris, fallen through a hole, unconscious or lost, and may be visually obscured by smoke and fumes. By providing radio alerting of outside personnel, and all three modes of emergency signalling, the present invention maximizes the probability of an effective rescue.

An additional feature is provision to radiate a warning tone on a normal walkie-talkie channel to alert other personnel not in immediate proximity of the display panel.

The invention will be better understood by referring to accompanying drawings in which:

FIG. 8 is a block diagram of the hand-held direction finder shown in FIG. 3.

FIG. 9 is a geometric diagram which is useful in explaining the operation of the direction finder.

FIGS. 10 and 11 are pictorial illustrations of a possible physical embodiment of the direction finder.

Figure 1:
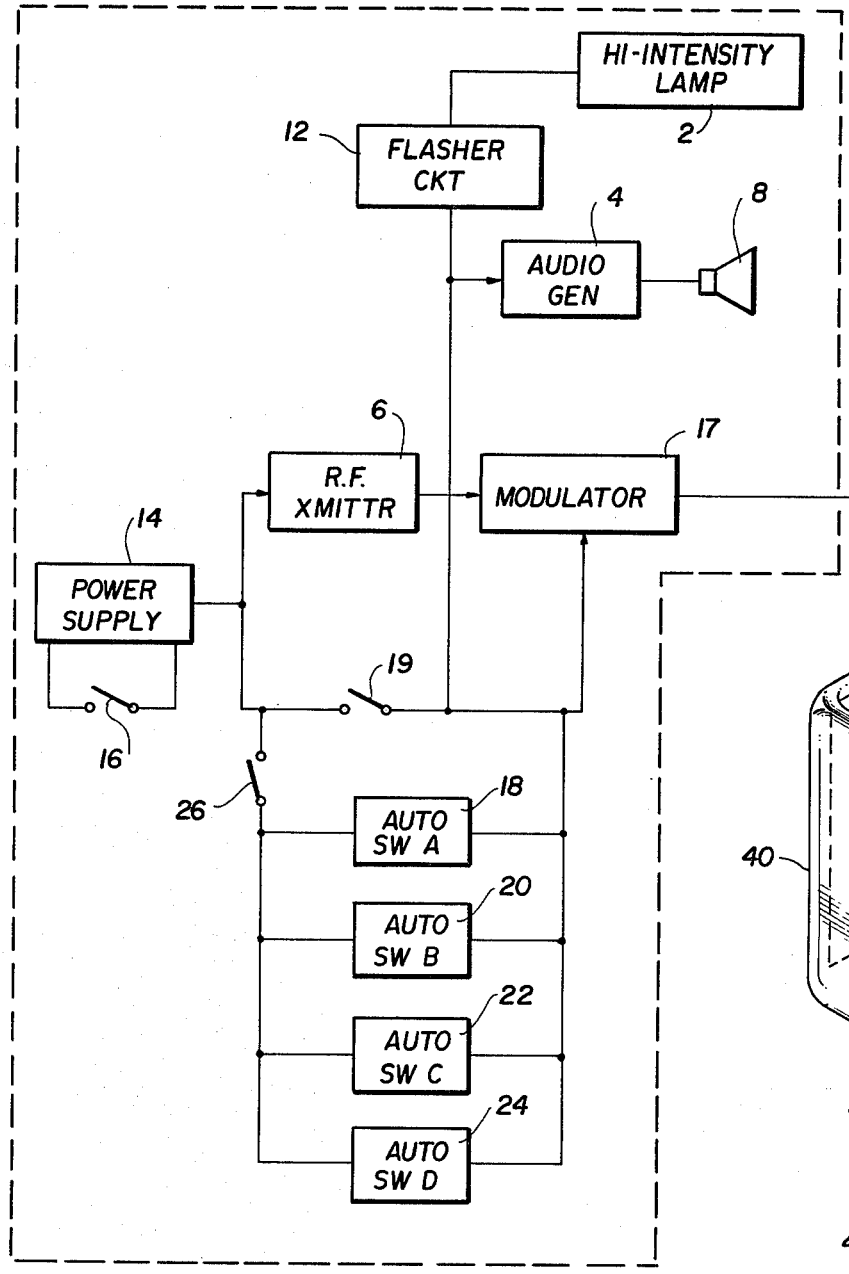
FIG. 1 is a block diagram of an embodiment of the emergency signalling unit of the present invention, adapted for generating a modulated carrier signal.

Referring to FIG. 1, it is seen that the emergency signalling unit of the invention includes high intensity light 2, audio generator 4, and RF transmitter 6. The high intensity light may be a lamp bulb, the audio generator may be an audio generator of conventional design or a pressurized gas device, and RF transmitter 6 may be a radio transmitter, crystal, or otherwise controlled to transmit at a desired radio frequency over a range which is great enough to be received by control personnel at the scene of a fire. Audio generator 4 drives loud speaker 8 or other appropriate audio transducer, while the RF power generated by transmitter 6 is fed into antenna 10 for transmission. Additionally, flasher circuitry 12 is provided for intermittently activating high intensity light 2. The flasher circuitry may for example be a relaxation oscillator, or digital timing circuitry which includes a digital clock and counter. Power is provided to the alarm signalling means by power supply 14, which is a rechargeable power supply. If the signalling unit is to be used in the alarm system described below, than modulator 17 for impressing an audio frequency tone on the carrier is provided, and is activated by switch 19, or automatic switch means 18, 20, 22 or 24.

In the operation of a basic unit, a fireman desiring to generate emergency signals would manually close a switch, such as switch 16 in the Figure, and the circuit would be arranged to cause power from power supply 14 to be fed to light 2, audio generator 4 and RF transmitter 6 for generating the above-described alarm signals. If used in the alarm system described below, then it is not the carrier signal which is the alarm signal, but rather the modulated carrier, and in this case, both switches 16 and 19 must be closed to transmit alarm signals. Additionally, one or more switch means for automatically activating the alarms responsive to life-endangering situations are provided at 18, 20, 22 and 24, and are shown as triggering the modulator, although in an embodiment of the signalling unit without modulation, they would be connected to switch 16 instead of switch 19.

In FIG. 1, automatic switch means 18 is responsive to the lack of motion of the fireman for a predetermined period of time, and activates the alarm generators after the fireman has remained motionless for such period of time. For example, switch means 18 may be an apparatus mounted on the fireman's person which is responsive to angular position or angular rotation rate about 3 mutually perpendicular axes. It may also be responsive to linear acceleration in any direction. Angular position, for example, could be comprised of three pendulums each fixedly mounted on a shaft for swinging in a direction perpendicular to the shaft, thereby rotating the shaft. The three shafts are mounted to extend in mutually perpendicular directions and resond to X, Y, and Z axes. Each shaft would also have a shaft encoder mounted thereon for generating an electrical signal corresponding to the displacement of the shaft, and the outputs of the three encoders would be fed to a digital processor for emitting an output signal when the displacement of all three shafts is less than a preset value for a predetermined period of time. The digital processor would include comparator means for comparing the pendulum displacement signals with a reference value and timing means for ensuring that an output signal is emitted only when the comparator means has remained low for a preset period of time. In the alternative, instead of using shaft encoders, angular rate sensors may be used to sense the rate of rotation. Linear acceleration can be sensed by a round object within a sphere of larger diameter wherein motion of the round object causes vibrations of the sphere which can be electrically detected by a microphone or vibration sensor.

Switch means 20 is responsive to the loss of the fireman's respiration. The fireman's normal breathing apparatus includes a demand regulator diaphragm which oscillates back and forth in synchronism with inhaling and exhaling to respectively allow air under pressure to enter, and to block the air. To provide the loss of breathing detecting function, an electric contact can be added to the diaphragm and connected with a battery so that a pulse is emitted each time that the fireman inhales or exhales. The pulses would be inputted to a monostable multivibrator which would be arranged to time out if not reset by the pulses at shorter intervals than a preset duration, which would indicate that the fireman is breathing too slowly or not at all. The monostable output would be connected to trigger the alarms.

In the alternative, respiration sensing could be effected at the exhaust air one way value of the breathing apparatus, or with a chest strap equipped with a sensor for measuring the variation in chest circumference as the fireman breathes.

Switch means 22 in FIG. 1 is responsive to a predetermined low level of air in the self-contained air supply which the fireman carries. Commercially available air breathing apparatus has a low pressure warning device that produces an audio alarm, and this device may be connected to activate switch 22 as well.

Switch means 24 is responsive to certain temperature-time conditions of the ambient atmosphere which it is determined in advance cannot sustain life. That is, switch means 24 may be triggered responsive to a certain temperature level over a predetermined time, or for example, a certain higher level of temperature over a shorter time. In an actual embodiment, switch means 24 may be comprised of a thermistor sensing element, connected to an A to D converter, the output if which is connected to a digital processor. The processor, may for example include, a read only memory which is programmed with a table of various critical time-temperature combinations. The time that a particular temperature condition has been present would be determined by a timer in the processor, and the outputs of the read only memory representing the critical time-temperature combinations would be compared with the critical measured values by a comparator in the processor to determine if an alarm should be sounded. Of course, switch means responsive to conditions other than those described above may be included as part of the emergency signalling unit.

In referring to FIG. 1, it should be noted that the manual activation switch as well as all of the automatic switch means are connected in parallel so that closure of any one of them activates the alarm signals. Additionally, manually activated switch 26 is connected in series with the parallel combination of the automatic switches, and is for the purpose of interrupting alarm signals which may for some reason become activated in a non-emergency situation. Of course, switch 26 is kept closed in the ordinary operation of the unit.

Figure 2:
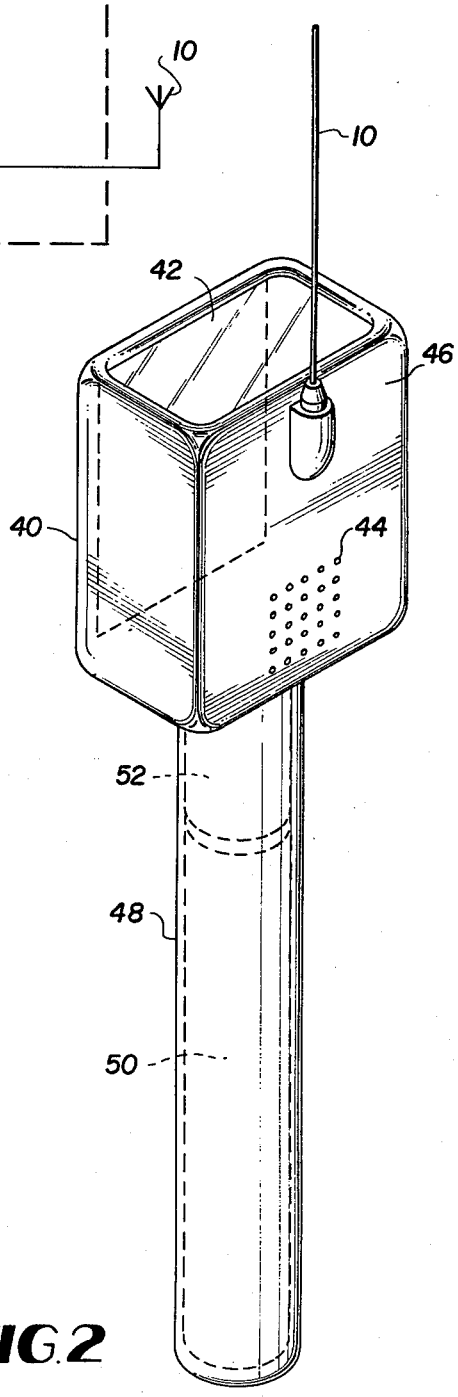
FIG. 2 is a pictoral illustration of a possible physical embodiment of the emergency signalling unit depicted in FIG. 1.

FIG. 2 is a pictoral illustration of a possible physical embodiment of the emergency signalling unit of the invention. Referring to the figure, it will be seen that a compact case 40, which is preferably constructed of heat resistant plastic is provided for enclosing the components illustrated in FIG. 1. The strobe light 2 of FIG. 1 is disposed underneath transparent plate 42 at the top of the unit while speaker 8 is disposed behind perforations 44 on side wall 45 of the housing. The antenna 10 which is in the form of a straight rod, is mounted on the housing so as to extend as shown in the figure.

A hollow tubular extension 48 projects from the bottom of the case and may be inserted into a specially designed elongated pocket on the fireman's coat. In the alternative, the unit may be hand-held by the tubular extension, as might be preferable in an emergency.

The batteries 50, for power supply 14 are disposed inside the hollow extension, while if a pressured gas cannister (for example $CO_2$), is used directly to power an audio transducer rather than utilizing an electrically driven transducer, then it too could be disposed in the tubular extension, as illustrated at reference numeral 52.

It is to be understood that the physical embodiment depicted in FIG. 2 is illustrative only and is not to be construed as being limiting, as many other specific embodiments are possible. For example, the unit could be mounted on the fireman's helmet, in which case the antenna could be disposed along the contour of the helmet, or if desired, the signalling unit could be made an integral part of a specially designed helmet. Alternatively, the unit could be mounted on the fireman's coat or in various arrangements on his belt. Of course, other mounting arrangements will occur to those skilled in the art, and are intended to be within the scope of the invention.

Figure 3:
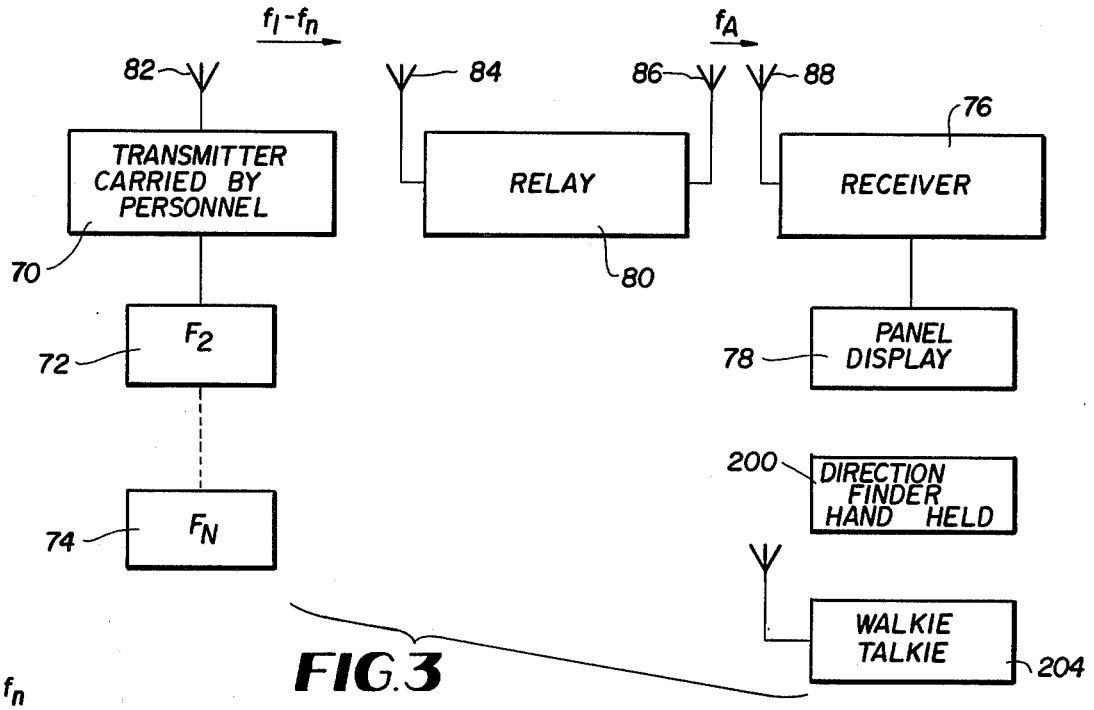
FIG. 3 is a block diagram of an embodiment of the alarm system of the present invention.

FIG. 3 is a block diagram of an alarm system according to the invention which incorporates the emergency signalling unit described above, and which is effective to alert outside personnel of an endangered fireman and to aid in locating him.

The system of FIG. 3 is comprised of a plurality of signalling units as shown in FIG. 1, each of which is carried by a different fireman, and each of which has an RF transmitter, denoted at 70, 72 and 74 in FIG. 3, which is arranged to transmit on a different carrier frequency. For example, the frequency of each transmitter may be controlled by a piezoelectric crystal which is resonant at a different frequency than the crystals used to control each other transmitter. The number of transmitters utilized is limited only by the available frequency bandwidth and the necessary frequency separation, which is dictated by the design constraints of specific systems.

Referring to FIG. 1, when the fireman enters the scene of the fire, he closes switch 16 to cause the signalling unit to transmit the carrier signal. If he encounters trouble and needs help then he closes switch 19 which causes the carrier to become modulated and activates the audio and visual alarms. The different carrier signals in the system are all modulated with the same modulation frequency signal.

Receiver 76 and panel display 78 are located exterior to the burning building at a control location. Panel display 78 has a plurality of light indicators, each corresponding to a different transmitter, and when an emergency signal is received from one of the transmitters, the appropriate light is ignited red, thus indicating the identity of the endangered fireman to control personnel. As will be described in greater detail below, the panel display may also include an audio alarm tone for alerting control personnel to the existence of an alarm condition. This alarm tone may also be radiated on a normal walkie-talkie channel to alert other personnel and a walkie-talkie is schematically indicated at reference numeral 204 in FIG. 3. Further, as will be described in detail below, a direction finder is used to locate the downed fireman and such is schematically represented at reference numeral 200 in FIG. 3.

A serious problem which sometimes arises in attempting to transmit radio signals from the interior to the exterior of a building is that the metal framework and other structural components of the building attenuate the signals to such a great degree that effective reception at the exterior is not possible. In order to overcome this problem, according to the present invention, a relay 80 which receives transmitted signals, amplifies them, and re-transmits them out of the building, may be provided. The relay is placed in an open area of the building such as a stairwell or a fire escape, whereby maximum transmission efficiency is achieved. The relay includes a means for converting the received carrier signals on frequencies $F_1$-$F_n$ to signals on a common carrier frequency $F_a$, in which case, the receiver 76 is tuned to the frequency $F_a$.

Figure 4:
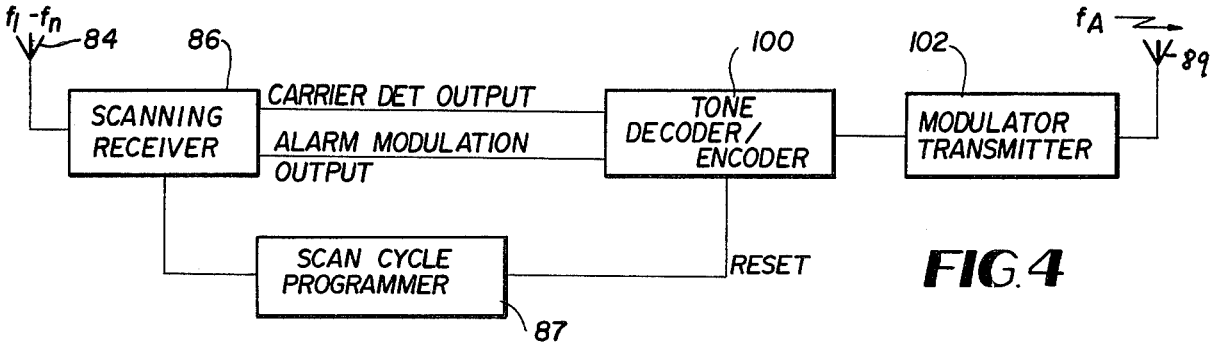
FIG. 4 is a block diagram of the relay shown in FIG. 3.

FIG. 4 is a block diagram of an embodiment of relay 80 of FIG. 3 and is comprised of antenna 84, scanning receiver 86, scan cycle programmer 87, decoder/tone encoder 100, modulator/transmitter 102, and transmission antenna 86. The frequency scanner, which is comprised of receiver 86 and programmer 87 is conventional circuitry for scanning a plurality of channels at a predetermined rate. In the embodiment shown, scan cycle programmer 87 changes the frequency of a local oscillator in the receiver 86 in a predetermined stepped manner, while the output of the local oscillator is fed to a mixer, and the output of the mixer is fed to an amplifier, a detector, and an output selector switch. As the local oscillator frequency changes, respective channels over the frequency band are scanned, and the program sequencer, which controls the rate of frequency change of the local oscillator, determines the scanning rate and the dwell time on each channel. A typical scan time for a conventional radio scanner is 0.5 seconds per channel.

The scanning receiver 86 includes a detector which is tuned to the modulation frequency of the alarm signalling units, and the circuitry of the receiver is arranged so that as the receiver scans each of the carrier frequency channels, the output of the receiver as on the two lines shown in the Figure, is either (1) no output; (2) carrier signal only; or (3) both carrier signal and modulation. Additionally, once each scan cycle, programmer 87 emits a reset pulse which is fed to unit 100, which includes a decoder means for recognizing the three input states mentioned above, and the reset state. The tone encoder of unit 100 is arranged to generate one of four different tones depending on which of the three input states or reset pulse is present for a given channel, and the tones are used to cause a modulator in modulator/transmitter 102 to modulate the signal carrier frequency $F_a$ with one of four respective modulation states. The transmitter output is fed to antenna 89 for transmission to the monitor station.

Figure 5:
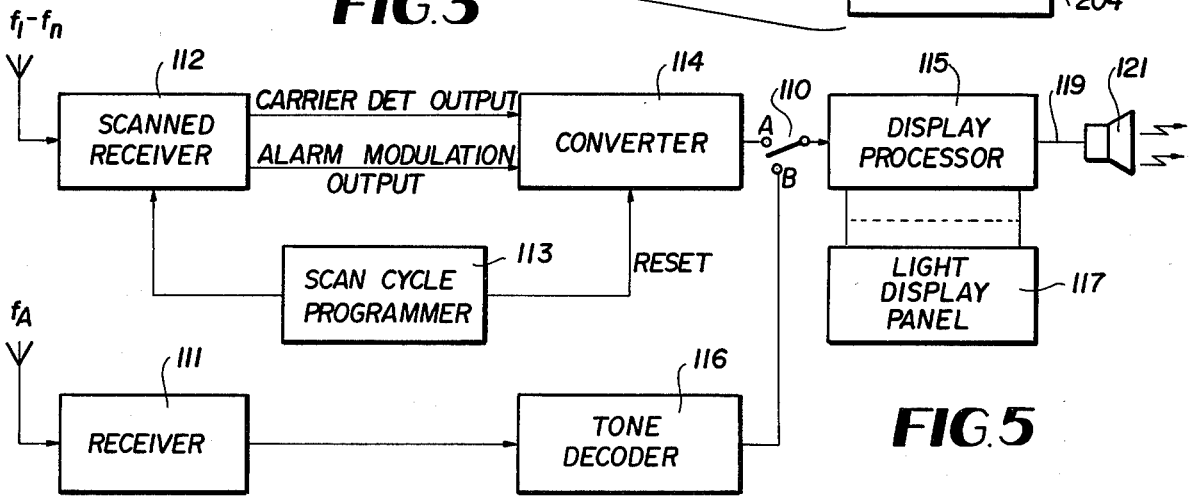
FIG. 5 is a block diagram of an embodiment of the receiver shown in FIG. 3.
Figure 6:
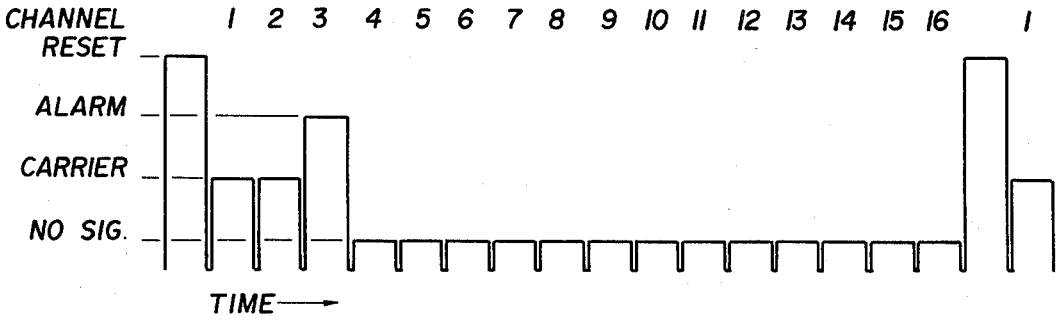
FIG. 6 is a graphical diagram showing voltage levels vs. time slot.

FIG. 5 is a block diagram of an embodiment of receiver 76 and panel display 78 of FIG. 3. The embodiment depicted is arranged to be used either with or without the relay shown in FIG. 4, depending on the position of switch 110. Thus, when the switch is in position A, the receiver is directly responsive to the carrier signals emitted by the emergency signalling units, and in this case, scanner 112, which is identical to scanner 86 described in connection with FIG. 4, is connected to converter 114. Converter 114 includes a decoder and a voltage level generator, and provides a voltage-line waveform as illustrated in FIG. 6. By way of illustration channels 1 and 2 are receiving carrier only, channel 3 is an alarm indication and channels 4 through 16 are receiving no signal.

On the other hand, if switch 110 is in position B, then tone decoder 116 is connected to display processor 115 and the receiver is responsive to the modulated carrier frequency $F_a$. The tone decoder may be a conventional decoder such as that which includes a plurality of filter means, each of which is responsive to a different modulation frequency which may be impressed on the carrier signal $F_a$ and convert these to voltage levels acceptable to the display processor 180, such as are shown in FIG. 6.

The outputs of display processor 115 are fed to driver units for igniting light emitting diodes or other lamp means of display panel 117. Each of such lamps corresonds to a particular emergency signalling unit, so that by observing which of the lamps is or are ignited, control personnel may determine the identity of the endangered fireman. Display processor 115 includes logic such as a pair of D-type flip-flops connected to a counter in synchronism with channel scanning, wherein the flip-flops decode the four voltage levels and determine whether the display lamps are to be ignited green (carrier only), red (alarm-carrier+modulation) or amber (no carrier received). Additionally, display processor 115 has an output 119 activated when any red light is ignited, which is connected to audio alarm means 121 for emitting an audio alarm to alert control personnel.

Figure 7:
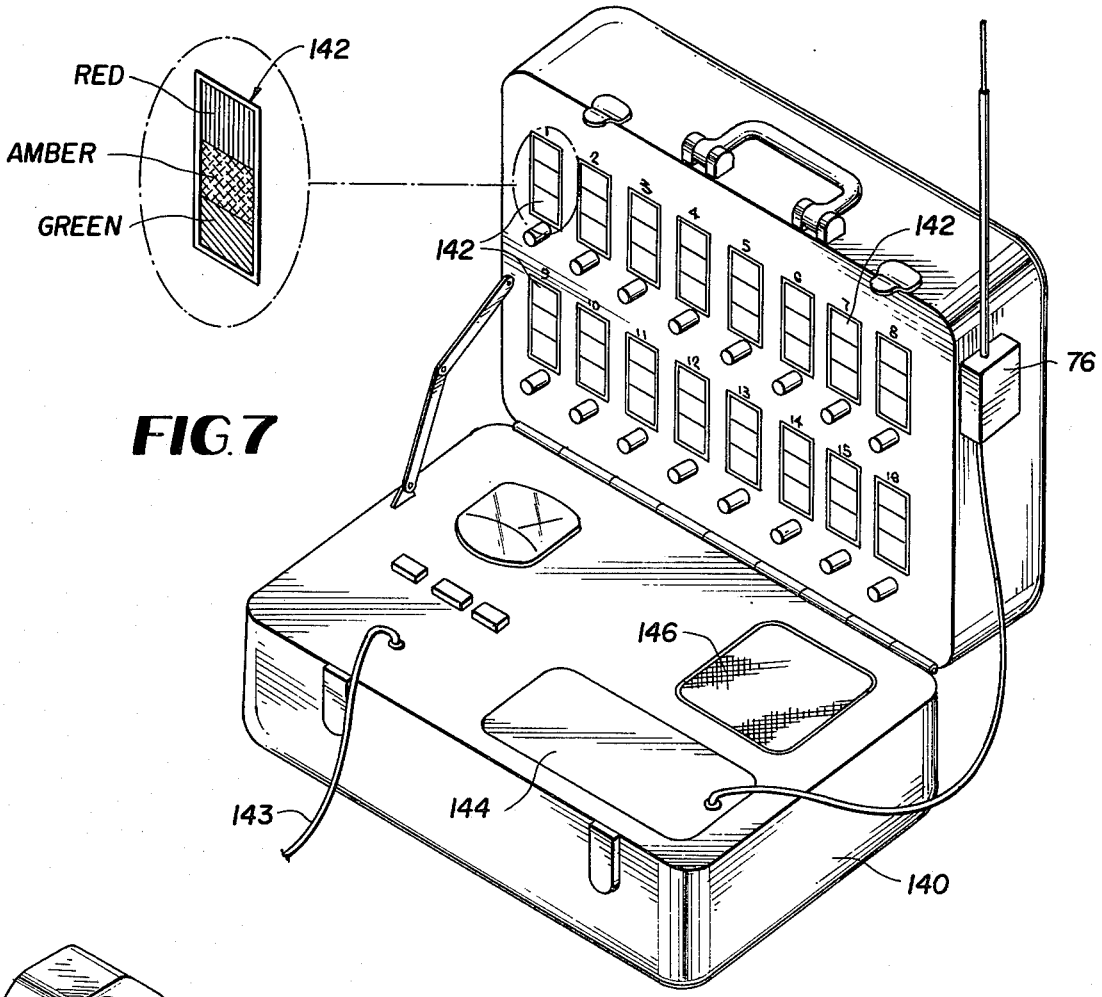
FIG. 7 is a pictorial illustration of a possible physical embodiment of a control console while includes the receiver and display panel shown in FIG. 3.

FIG. 7 is a pictorial illustration of a possible physical embodiment for the receiver/control panel. The panel is preferably an integral part of a carrying case 140, so that it may be easily transported. It includes a plurality of windows 142 which are in front of individual lamps, and which number sixteen in the specific embodiment shown in the figure, but which of course may be any desired number. If desired, and as shown in the inset to the figure, each of the windows 142 may be divided into a red, amber and a green portion with a lamp disposed behind each portion. Circuitry may be provided to maintain the green light in the ignited state when a channel has been placed in service and until an alarm signal is received for a particular channel, whereupon the lamp behind the green portion is extinguished and the light behind the red portion is ignited. A loss of carrier reception will be indicated by the amber light igniting indicating that alarm reception is not possible. Channels are placed in service or assigned by means of push-pull switches below the associated lamp; when assigned, one of the three lamps is on for each channel; when not assigned, none of the three for that channel are on. In the embodiment illustrated, receiver antenna 76 may be attached to carrying case 140 by a magnetic mounting means, and storage area 144 may be provided in the case for a receiver antenna and cable. Additionally, speaker 146 corresponds to the output of alarm audio unit 121 in FIG. 5 for providing an audio alarm signal to alert control personnel when any of the red lights become ignited.

To reduce power consumption, the carrier of the signalling units may be on, for example, for a 20% duty factor at a sufficient sample rate to check path attenuation and equipment operability. For example, its on time could encompass one scan cycle of the receiver, then be off for four scan cycles. Logic in the receiver decoder can determine when the amber condition is indicated.

Once an alarm indication is received, the hand-held direction finder 200 schematically represented in FIG. 8 can be used to begin location of the disabled fireman. The operator first switches the direction finding unit to the channel frequency of the emergency signalling unit carried by the disabled fireman, and observes the indicator on the unit to determine which direction to point it to. The unit is manipulated until a null indication is received, indicating that it is directed towards the transmission signal, and the operator can then begin moving towards the source of the signal.

Figure 10:
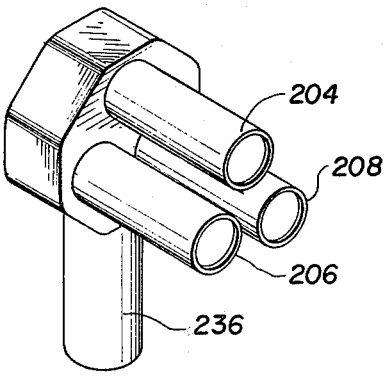

A block diagram of a suitable direction finding unit is shown in FIG. 8, and is explained in connection with the geometrical diagram of FIG. 9. Referring to FIG. 8, local oscillator 202 is provided for tuning the direction finder to the appropriate transmission frequency. Three helical antennas, 204, 206 and 208 are provided, and a possible physical arrangement of them is shown in the pictorial illustration of FIG. 10.

In the following description $H\sphericalangle$ and $V\sphericalangle$ are used to describe angular displacement in two planes nominally perpendicular and figuratively referred to as horizontal and vertial. Because of the fixed physical relationship between 228 FIG. 11 and 204, 208, 206 FIG. 10 and FIG. 11, correct pointing indication results even though the referred to plane may be neither horizontal or vertical for a particular position of the hand held direction finder. Antenna 208 is utilized in a reference channel REF, while antennas 206 and 204 are utilized in channels used to compute the horizontal deviation angle $H\sphericalangle$ indicative of the horizontal deviation between the direction the finder is pointed in and the direction of the source and the vertical deviation angle $V\sphericalangle$ indicative of the vertical deviation between the direction the finder is pointed in and the direction of the source. As shown in FIG. 8, the antennas 208, 206 and 204 are coupled to mixers 210, 212 and 214 respectively, which mix the local oscillator frequency which is routed to the respective mixers through power divider 216 with the incoming frequency to produce an intermediate frequency. The outputs of the IF amplifiers 218, 220 and 222 are routed to phase comparators 224 and 226 in the manner shown in the figure, and phase comparator 224 provides an analog output signal proportional to a horizontal deviation angle $H\sphericalangle$ while phase comparator 226 produces an analog voltage corresponding to the vertical deviation angle $V\sphericalangle$. The outputs of the phase comparators are fed to a visual indicator 228, which displays the deviations between the direction that the direction finder is pointed towards and the apparent direction of the alarm signal. Driving the three channels with a common local oscillator allows identical phase shift from the antenna input terminal to the IF amplifier output of each of the three channels.

Reference to FIG. 9 and the equations below will explain why the outputs of phase comparators 224 and 226 are proportional to the horizontal and vertical deviation angles respectively. FIG. 9 is illustrated for the case where the REF channel and $H\sphericalangle$ channel antennas and the REF channel and $V\sphericalangle$ channel antennas are separated by $(\lambda/2)$ and wherein the path length difference between the H∢ channel antenna and the signal source and the REF channel antenna and the signal source is $\Delta L_1$ while the path length difference between the REF channel antenna and the signal source and the V∢ channel antenna and the signal source is $\Delta L_2$. The equations below are for determining the carrier phase difference for the horizontal angle but similar equations hold for determining the vertical phase difference.

$$\Delta\phi \approx 2\pi\Delta L_1/\lambda$$

where, referring to FIG. 9, $$\Delta L_1 \approx (\sin\theta)\times(80/2)$$

$$\text{or } \Delta\phi \approx 2_\pi/\times(\lambda/2)\times\sin\theta$$

$$\text{or } \Delta\phi \approx \pi\times\sin\theta$$

wherein $\theta$ = radians $\lambda$ = wavelength

Helical antannas are appropriate for the direction finder since they inherently receive circular polarization and by using linear polarization at the alarm transmitters polarization diversity is assured and rotational position about the boresight axis of the direction finder is not critical. Also, the antenna pattern from a helical antenna is mildly directional, thereby reducing the possibility of a false null that could occur with the subject behind the direction finder on the boresight axis instead of in front.

The direction finder illustrated in FIGS. 8 and 9 is well-known, and by itself forms no part of the present invention. FIG. 11 is another view of the physical embodiment of the direction finder, shown in FIG. 10, and illustrates up/down, left/right, direction indicator 228, frequency indicator 230, intensity indicator 232 which indicates relative distance, attenuation control 234, and handle 236 by which the unit may be held. Of course, many other specific physical embodiments are possible for the direction finding unit.

In the operation of the emergency alarm system of the invention, while firemen are working in a burning building, control personnel monitor the control panel shown in FIG. 7. Upon hearing the audible alarm, they check which of the lamps is ignited red, which provides identification of the endangered fireman. A rescuer then utilizes the hand-held direction finder illustrated in FIGS. 8 to 11 by tuning it to the appropriate channel, and manipulating it until a null is achieved to determine the direction of the transmitter signal. Additionally, as described above, the emergency signalling units illustrated in FIGS. 1 and 2, emit a visual and an audible alarm to further aid the rescuer in determining the location of the endangered fireman when the rescuer gets closer. At the same time, other fireman working in the vicinity will be alerted by these alarms and may also contribute to the rescue effort, or attempt an independent rescue.

The hand-held direction finding unit can also be used to aid the safe return after locating and while retrieving the endangered person. This is accomplished by placing a homing transmitter on a specific channel, say #16 for example, not assigned to a person, in a safe place, and by switching the hand-held direction finder to that channel. This can be beneficial wherein the path followed upon entering the structure is now no longer possible and a new way out must be faced.

In accordance with a further aspect of the invention. physical path finder units are provided, and the rescue team places such units in strategic locations along the path which it follows to the endangered fireman. The rescue team may then use the path finder units as an aid to finding their way back to the outside of the building.

The rescue team may be envisioned as consisting of two to three man, one carrying the direction finder unit and the other, in addition to the normal equipment of axes, poles, etc., carrying a garrison belt containing the path finder units. Each of these units is comprised of a high intensity flashing light which illuminates a numbered arrow (directing) lens, a switch operated beeper, a power source, and mounting means such as magnets, hooks, adhesive material, etc. Instead of being mounted, the unit may simply be placed on the floor.

In use, as the rescue team walks to the endangered fireman, the fireman carrying the path finder units places them in visible places along the route. Each unit is numerically marked in order (i.e. No. 1, 2, 3, etc.), and are mounted on the garrison belt in that order. Thus, by the time the rescue team reaches the endangered fireman, a well marked path has been defined.

After reaching the endangered fireman, the rescue team will notify the control by radio and if more equipment or personnel are required, they will have the benefit of the path finder trail to the rescue sight. The same trail will then be used to retreat to the outside of the building, and/or as mentioned above, the direction finder unit may be used by tuning it to the channel of the pre-assigned homing signal.

It should be understood that while we have described certain embodiments of the invention, we do not intend to be restricted thereto, but rather intend to cover all variations and modifications which come within the spirit of the invention, which is limited only by the claims which are appended hereto.

We claim:

1. An emergency signalling unit to be carried on the person of a fireman or other emergency worker to alert others should the life of the fireman or emergency worker become endangered and to aid in locating the fireman or worker in such a situation, said unit being capable of transmitting both a radio carrier signal by itself and a modulated carrier signal, comprising, radio transmitter means for generating a radio carrier signal, modulator means for generating a modulation signal for modulating said carrier signal, high intensity lamp means for generating a visual emergency signal, audio frequency signal source means for generating an audible emergency signal, power supply means connected to said transmitter means, said modulator means, said lamp means and said audio frequency signal generator means, first switch means connected between said power supply means and said transmitter means for switchably providing electrical power to said transmitter means to cause said transmitter means to generate said radio carrier signal, second switch means connected between said power supply means and said modulator means, said lamp means and said audio frequency signal source means for switchably supplying power to said modulator means, said lamp means and said audio frequency signal source means to cause said modulation signal to be generated for modulating said carrier signal and to cause said lamp means and said audio frequency signal source means to provide visual and audible emergency signals respectively, and housing means for containing said radio transmitter means, said modulator means, said lamp means, said audio frequency signal source means, and said power supply means, said housing means being adapted for being carrier by said fireman or other worker.

2. The signalling unit of claim 1, wherein said second switch means includes means responsive to a life-endangering condition.

3. The signalling unit of claim 2, wherein said life-endangering condition is lack of motion of such fireman or other worker for a predetermined period of time.

4. The signalling unit of claim 2, wherein said life-endangering condition is loss of respiration of the fireman or other worker.

5. The signalling unit of claim 2, wherein said fireman or worker carries a self-contained air supply, and wherein said life-endangering condition is a predetermined low level of air in said air supply.

6. The signalling unit of claim 2, wherein said life-endangering condition is certain temperature/time conditions of the ambient atmosphere.

7. An alarm system for use at the scene of a fire or other emergency for alerting control personnel at a central station should the life of a fireman or emergency worker become endangered, and for identifying the endangered fireman or worker and aiding in locating him, said system comprising (a) a plurality of signalling units, each being carried by a different fireman or worker and each unit being capable of transmitting both a radio carrier signal by itself and a modulated carrier signal, each signalling unit comprising, radio transmitter means for generating a radio carrier signal, modulator means for generating a modulation signal for modulating said carrier signal, high intensity lamp means for generating a visual emergency signal, audio frequency signal source means for generating an audible emergency signal, power supply means connected to said transmitter means, said modulator means, said lamp means and said audio frequency signal generator means, first switch means connected between said power supply means and said transmitter means for switchably providing electrical power to said transmitter means to cause said transmitter means to generate said radio carrier signal, second switch means connected between said power supply means and said modulator means, said lamp means and said audio frequency signal source means for switchably supplying power to said modulator means, said lamp means and said audio frequency signal source means to cause said modulation signal to be generated for modulating said carrier signal and to cause said lamp means and said audio frequency signal source means to provide visual and audible emergency signals respectively, and housing means for containing said radio transmitter means, said modulator means, said lamp means, said audio frequency signal source means, and said power supply means, said housing means being adapted for being carrier by said fireman or other worker, the radio transmitter means of each signalling unit being arranged to transmit a carrier signal at a different frequency than the carrier signal transmitted by the transmitter means of each other signalling unit, (b) frequency scanning means located at said central station for scanning said different carrier frequencies, and (c) display means located at the central station for providing an indication of which signalling units are transmitting a carrier signal only, which are transmitting a modulated carrier signal, and which are transmitting no radio signal, said display means including, means for determining whether a signal is received at each carrier frequency, and whether it is carrier only, or a modulated carrier, and for providing a unique voltage level corresponding to each of these three conditions, and means for causing each of said unique voltage levels to result in a corresponding unique display condition.

8. The system of claim 7, wherein said plurality of emergency signalliing units are deployed on firemen or other workers who are working in a building and wherein said central station is outside said building, further including a repeater means including receiver means, amplifier means, and transmitter means, which is placed in a stairwell or other open area of said building for receiving signals transmitted by said emergency signalling units which are greatly attenuated by the walls of said building and for re-transmitting said signals to said central station.

9. The system of claim 8, further including a direction finding unit for locating the endangered fireman.

* * * * *